US008259026B2

(12) United States Patent
Pulimi et al.

(10) Patent No.: US 8,259,026 B2
(45) Date of Patent: Sep. 4, 2012

(54) COUNTERPOISE TO MITIGATE NEAR FIELD RADIATION GENERATED BY WIRELESS COMMUNICATION DEVICES

(75) Inventors: Narendra Pulimi, Round Lake, IL (US); Vijay L. Asrani, Round Lake, IL (US); Ali Ghoreishi, Naperville, IL (US); Ross J. Lahlum, Mt. Prospect, IL (US); Adrian Napoles, Lake Villa, IL (US); Sung-Hoon Oh, San Diego, CA (US); Istvan J. Szini, Grayslake, IL (US)

(73) Assignee: Motorola Mobility LLC, Libertyville, IL (US)

( * ) Notice: Subject to any disclaimer, the term of this patent is extended or adjusted under 35 U.S.C. 154(b) by 343 days.

(21) Appl. No.: 12/415,835

(22) Filed: Mar. 31, 2009

(65) Prior Publication Data

US 2010/0164829 A1 Jul. 1, 2010

Related U.S. Application Data

(60) Provisional application No. 61/142,144, filed on Dec. 31, 2008.

(51) Int. Cl.
*H01Q 1/48* (2006.01)
*H01Q 1/24* (2006.01)

(52) U.S. Cl. ..... 343/846; 343/848; 343/702

(58) Field of Classification Search ..... 343/702, 343/700 MS, 846, 848; 455/269, 272, 274, 455/575.1, 575.19
See application file for complete search history.

(56) References Cited

U.S. PATENT DOCUMENTS

| | | | | |
|---|---|---|---|---|
| 4,352,109 | A | 9/1982 | Reynolds et al. | |
| 4,518,968 | A | 5/1985 | Hately | |
| 4,628,322 | A | 12/1986 | Marko et al. | |
| 4,700,194 | A | 10/1987 | Ogawa et al. | |
| 4,868,576 | A | 9/1989 | Johnson | |
| 5,257,033 | A | 10/1993 | Roche | |
| 5,612,705 | A | 3/1997 | Openlander | |
| 6,421,016 | B1 | 7/2002 | Phillips et al. | |
| 6,727,785 | B2 | 4/2004 | Killen et al. | |
| 7,633,449 | B2 | 12/2009 | Oh et al. | |
| 7,714,789 | B2 * | 5/2010 | Tsai et al. | 343/702 |
| 7,941,116 | B2 * | 5/2011 | Man et al. | 455/269 |
| 2006/0220966 | A1 * | 10/2006 | Sarychev et al. | 343/702 |
| 2006/0293078 | A1 | 12/2006 | Qi et al. | |
| 2007/0229372 | A1 | 10/2007 | Desclos et al. | |
| 2007/0247389 | A1 | 10/2007 | Qi et al. | |
| 2009/0085812 | A1 | 4/2009 | Qi et al. | |
| 2009/0143040 | A1 | 6/2009 | Man et al. | |
| 2010/0123640 | A1 * | 5/2010 | Hui et al. | 343/848 |

OTHER PUBLICATIONS

Ponce De Leon, Lorenzo, "iDEN Subscriber Technology 2005 Fall Antenna Sumposium," iDEN Antenna Lab, Motorola Networks, Motorola, Inc., 2004, 11 pages.

* cited by examiner

*Primary Examiner* — Hoang V Nguyen

(57) ABSTRACT

A method (1400) and an RF circuit (100, 400, 700, 1000, 1100, 1200, 1300) for a wireless communication device that mitigates near field radiation generated by the wireless communication device. At least one counterpoise (104, 404, 1304) can be configured to resonate at or near at least one operating frequency of an antenna (102) of the wireless communication device. The antenna can be a component of the RF circuit. The counterpoise can be electromagnetically coupled to the antenna to mitigate near field radiation of the antenna at the at least one operating frequency of the antenna in order to comply with an applicable hearing aid compatibility (HAC) specification.

10 Claims, 8 Drawing Sheets

COUNTERPOISE TO MITIGATE NEAR FIELD RADIATION GENERATED BY WIRELESS COMMUNICATION DEVICES

CROSS REFERENCE TO RELATED APPLICATIONS

This application claims benefit of U.S. provisional patent application Ser. No. 61/142,144, filed Dec. 31, 2008, which is herein incorporated by reference.

BACKGROUND OF THE INVENTION

1. Field of the Invention

The present invention generally relates to RF antennas and, more particularly, to RF antennas for mobile communication devices.

2. Background of the Invention

The Hearing Aid Compatibility Act of 1988 (HAC Act) requires that the Federal Communications Commission (FCC) ensure that telephones manufactured or imported for use in the United States after August 1989 are compatible with hearing aids. When the Act was passed in 1988, Congress specifically exempted from the hearing aid compatibility requirements "telephones that are used with public mobile services" (e.g. wireless telephones). To ensure that the HAC Act keep pace with the evolution of telecommunications, however, Congress granted the FCC the authority to revoke or limit the exemptions provided in the HAC Act for wireless telephones.

The use of wireless telephones by consumers in the United States proliferated significantly in the years following the HAC act, and by 2003 the FCC determined that continuation of the exemption for wireless telephones would adversely affect individuals with hearing disabilities. Moreover, the FCC also determined that providing a limitation on this exemption was both technologically feasible and in the public interest. Pursuant to these determinations, and acting under its authority granted by Congress, the FCC implemented new rules for hearing aid compatibility applicable to digital wireless telephones. These rules became effective in 2008.

The new rules implemented by the FCC establish limits on both electric near field radiation and magnetic near field radiation generated by digital wireless telephones. Further, the rules mandate that 50% of the digital wireless telephones provided by wireless communication carriers must meet the near field radiation limits, and that these limitations must be met without compromising the overall performance of the digital wireless telephones.

An indicator of a wireless telephone's performance is the telephone's total radiated power (TRP). TRP represents the amount of power radiated by a wireless telephone, and therefore roughly correlates to its broadcast range. Thus, to comply with the applicable FCC rules for hearing aid compatibility, digital wireless telephones should provide sufficient TRP while maintaining both electric near field radiation and magnetic near field radiation within the applicable limits specified by the FCC.

SUMMARY OF THE INVENTION

The present invention relates to a method of mitigating near field radiation generated by a wireless communication device. The method can include configuring at least one counterpoise to resonate at or near one or more operating frequencies of an antenna of the wireless communication device. The method also can include electromagnetically coupling the counterpoise to the antenna to mitigate near field radiation of the antenna at the operating frequencies of the antenna in order to comply with an applicable hearing aid compatibility (HAC) specification.

Another aspect of the present invention relates to an RF circuit for a wireless communication device. The RF circuit can include an antenna and at least one counterpoise configured to resonate at or near one or more operating frequencies of the antenna. The counterpoise can be electromagnetically coupled to the antenna to mitigate near field radiation of the antenna at the operating frequencies of the antenna in order to comply with an applicable hearing aid compatibility (HAC) specification.

BRIEF DESCRIPTION OF THE DRAWINGS

Preferred embodiments of the present invention will be described below in more detail, with reference to the accompanying drawings, in which.

DETAILED DESCRIPTION

While the specification concludes with claims defining features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Arrangements described herein relate to mitigating electric near field radiation and magnetic near field radiation generated by wireless communication devices without appreciably degrading their transmission and reception performance. Specifically, the present arrangements describe architectures that limit the generation of electric and magnetic near field radiation without significantly interfering with the far field transmission and reception characteristics of a wireless communication device. Moreover, these architectures are well suited for adaptation in mass production of wireless communication devices while requiring very few dedicated components. Accordingly, the arrangements described herein provide manufacturers of wireless communication devices a cost effective means for complying with applicable rules promulgated by the Federal Communications Commission (FCC) under the Hearing Aid Compatibility Act of 1988 (HAC Act).

Figure 1:
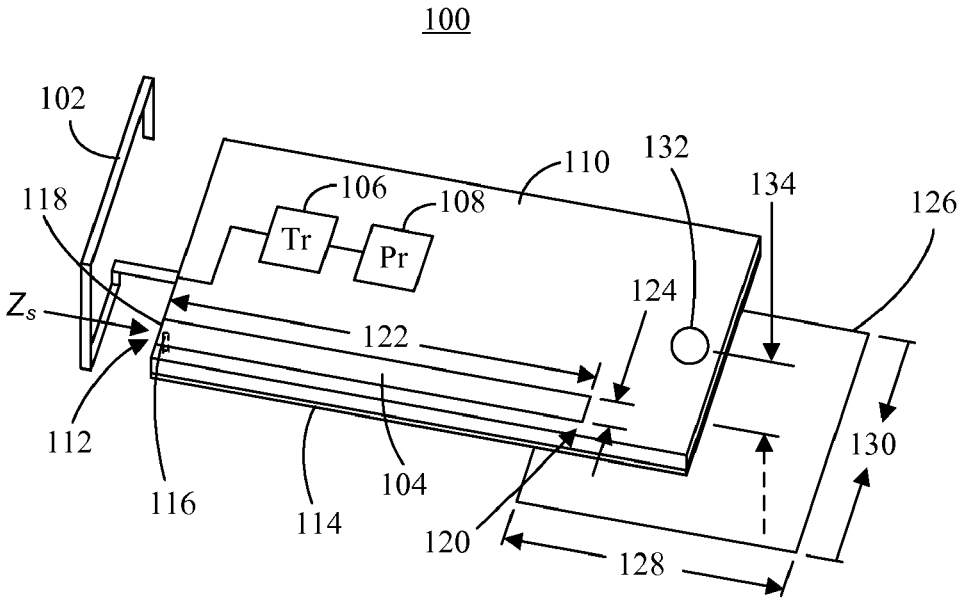
FIG. 1 depicts an RF circuit of a wireless communication device that is useful for understanding the present invention.

FIG. 1 depicts an RF circuit 100 of a wireless communication device that is useful for understanding the present invention. The RF circuit 100 can include an antenna 102 and a counterpoise 104, which may be used as a resonant structure. The antenna 102 can be a folded-J antenna, a planar antenna, a monopole antenna, a dipole antenna, a patch antenna, a ceramic chip antenna, or any other suitable type of antenna.

The counterpoise 104 can be electromagnetically coupled to the antenna 102 to mitigate near field radiation of the antenna 102 at the operating frequency $f_0$ of the antenna 102 in order to comply with an applicable hearing aid compatibility (HAC) specification. As used herein, the term "counterpoise" means a resonant line that is electromagnetically coupled to an antenna and which comprises at least one port that is electrically coupled to a ground potential, for instance to a ground plane.

Other devices also can be included in the RF circuit 100. For example a transceiver 106, processor/controller 108, and/or or any other devices which may be used by a wireless communication device can be provided, as would be known to those skilled in the art of wireless communication devices. For the purpose of clarity, such other devices are not presented in the figures.

The counterpoise 104 can be configured to have a structure that is straight, curved, or comprise any of a myriad of different structural geometries. For example, the counterpoise 104 can include portions which are straight, portions which are curved, portions which include angles, and so on.

The counterpoise 104 can be positioned on a printed circuit board 110, for example as a conductive trace. A first port 112 of the counterpoise 104 can be electromagnetically coupled to the antenna 102. For instance, the first port 112 of the counterpoise 104 can be positioned proximate to the antenna 102. Further, the first port 112 can be electrically coupled to a ground potential. By way of example, the first port 112 can be electrically connected to a ground plane 114 with a via 116, a pin, or any other suitable conductor. The via 116 can be located at or near an end 118 of the counterpoise 104 nearest to the antenna 102. In this regard, the counterpoise can resemble a single port resonant line with an open load 120, and can be referenced to the same ground potential as the antenna 102.

A length 122 of the counterpoise 104 can be selected based on a wavelength of the operating frequency of the antenna 102. For example, the length 122 can be equal to, or close to, a fraction of the wavelength (e.g. one-quarter of the wavelength), or any multiple of the fractional wavelength. In one arrangement, the length 122 of the counterpoise can be selected so that the input impedance ($Z_s$) of the counterpoise 104 appears low for near field radiation coupling from the antenna 102 to the counterpoise 104 at the first port 112 of the counterpoise 104. Accordingly, the counterpoise 104 can sink the portion of the near field electromagnetic signals generated by the antenna 102 that electromagnetically couple to the counterpoise 104. The length 122 of the counterpoise will be discussed herein in greater detail.

The characteristic impedance ($Z_0$) of the counterpoise may be determined by the following equation:

$$Z_0 = \sqrt{\frac{Z_L}{Z_C}}$$

where $Z_L$ is the inductance per unit length of the counterpoise 104 and $Z_C$ is the capacitance per unit length of the counterpoise 104. The values of $Z_L$ and $Z_C$ are generally determined by the physical geometry of the counterpoise 104, the spacing of the counterpoise 104 from the ground plane 114, and the dielectric constant of the substrate of the printed circuit board 110. Accordingly, a width 124 of the counterpoise 104 can be selected to achieve a desired characteristic impedance for the counterpoise 104 based on the permittivity of the printed circuit board 110 and the location of the ground plane 114, which in this example corresponds to a thickness of the printed circuit board 110. That said, the characteristic impedance of the counterpoise may match the characteristic impedance of the antenna 102, though this need not be the case.

The near field radiation generated by the RF circuit 100 can be measured in accordance with an applicable HAC specification. For example, the near field radiation generated by the RF circuit 100 can be measured using an electric field probe to measure the electric near field radiation and a magnetic field probe to measure the magnetic near field radiation. For example, the electric and magnetic field probes can be moved along an imaginary plane 126 at a distance 134 from an output audio transducer 132 of the RF circuit 100 while respective electric field and magnetic fields are measured. In one arrangement, the imaginary plane 126 can measure approximately 50 mm×50 mm square, and can be positioned approximately 15 mm away from the output audio transducer 132. Still, specifications pertaining to the measurement of near field radiation are subject to change, and thus the invention is not limited in this regard. Those skilled in the art are familiar with making such near field radiation measurements.

Additional embodiments of RF circuits are presented herein. Throughout this specification like numbers will be used to refer to the same items depicted in various embodiments.

Figure 2:
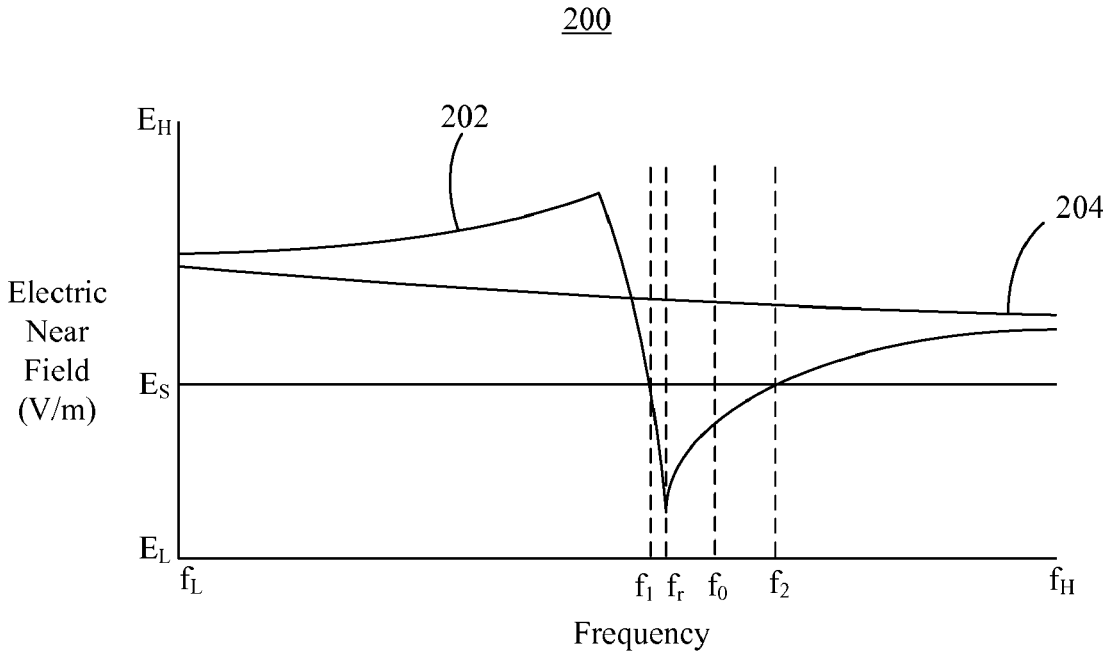
FIG. 2 depicts a chart presenting plots of an electric near field vs. frequency that is useful for understanding the present invention.

FIG. 2 depicts a chart 200 presenting a plot 202 of an electric near field generated by the antenna 102 vs. frequency when the counterpoise 104 is implemented in the RF circuit 100 of FIG. 1. The chart 200 also presents an electric near field limit ($E_s$) provided by an applicable HAC specification, as well as a plot 204 of the electric near field generated by the antenna 102 in an RF circuit which does not include the counterpoise 104.

As can be seen by comparing the plot 202 to the plot 204, whereas an antenna in an RF circuit that does not include a counterpoise exceeds the electric near field limit ($E_s$) when transmitting, the antenna 102 in the RF circuit 100 that includes the counterpoise 104 can transmit RF signals while complying with the electric near field limit ($E_s$). Specifically, the counterpoise 104 can reduce the electric near fields generated by the antenna 102 to be at or below the specified electric near field limit ($E_s$) at frequencies above a first frequency ($f_1$). Moreover, the electric near fields generated by the antenna 102 can remain below the specified electric near field limit ($E_s$) over a band of frequencies spanning from the first frequency ($f_1$) to a second frequency ($f_2$).

The first frequency ($f_1$) and the second frequency ($f_2$) can be determined, at least in part, based on a resonant frequency ($f_r$) of the counterpoise 104, as well as the quality factor of the counterpoise 104. In general, the resonant frequency ($f_r$) of the counterpoise 104 will correspond to its length 122, although other devices may be electrically coupled to the counterpoise 104 to change the resonant frequency ($f_r$), as will be discussed herein. Accordingly, the length 122 of the counterpoise 104 can be selected to choose the first frequency ($f_1$) and the second frequency ($f_2$) such that the operating frequency ($f_0$) of the antenna 102 falls within this frequency band.

In illustration, the counterpoise 104 generally will resonate at frequencies having quarter-wavelengths, and multiples thereof, which correspond to the length 122 of the counterpoise 104. In this regard, the length of the counterpoise 104 can be selected to resonate at or near at least one operating frequency of the antenna 102. In illustration, if the operating frequency $f_0$ of the antenna 102 is 850 MHz, the length 122 of the counterpoise 104 can be selected to be equal to one-quarter of the 850 MHz wavelength (e.g. 88.2 mm) so as to exhibit a resonant frequency ($f_r$) at 850 MHz. The length also can be chosen to be longer so as to exhibit a resonant frequency ($f_r$) below the operating frequency ($f_0$) of the antenna 102 or shorter so as to exhibit a resonant frequency ($f_r$) above operating frequency ($f_0$), so long as the first frequency ($f_1$) is at or below the operating frequency ($f_0$) of the antenna 102 and the second frequency ($f_2$) is at or above the operating frequency ($f_0$).

Figure 3:
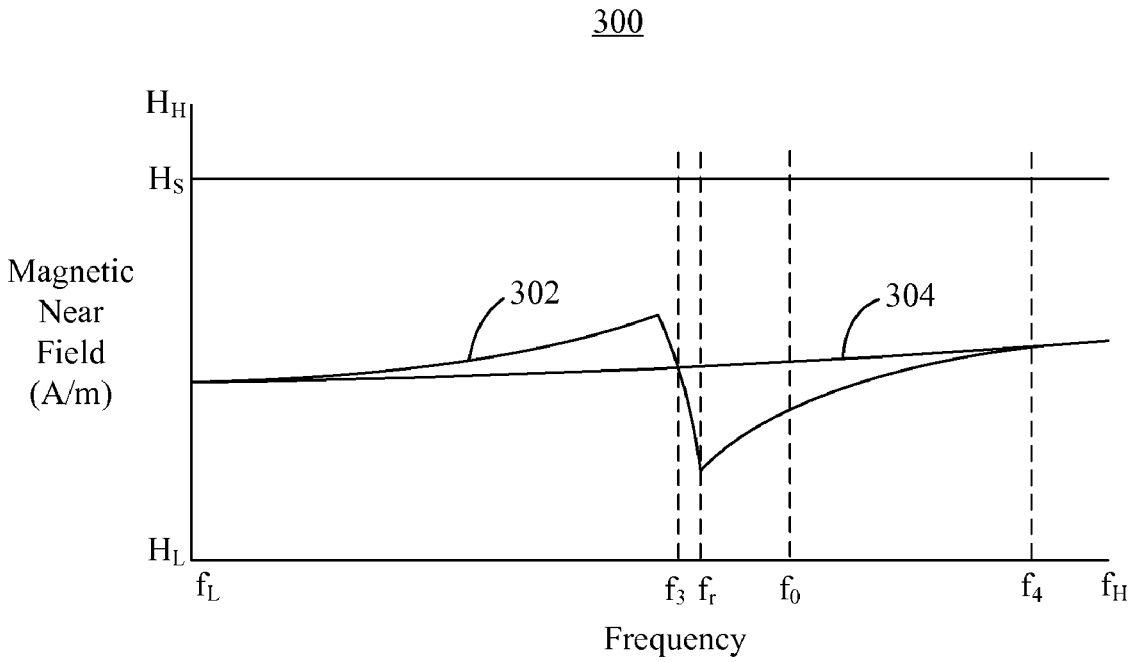
FIG. 3 depicts a chart presenting plots of a magnetic near field vs. frequency that is useful for understanding the present invention.

FIG. 3 depicts a chart 300 presenting a plot 302 of a magnetic near field generated by the antenna 102 vs. frequency when the counterpoise 104 is implemented in the RF circuit 100 of FIG. 1. The chart 300 also presents a magnetic near field limit ($H_s$) provided by an applicable HAC specification, as well as a plot 304 of the magnetic near field generated by the antenna 102 in an RF circuit which does not include the counterpoise 104.

In this example, the magnetic near field generated by the antenna 102 in an RF circuit which does not include the counterpoise 104 is below the specified magnetic near field limit ($H_s$). Nonetheless, by comparing the plot 302 to the plot 304, it can be seen that use of the counterpoise 104 within the RF circuit 100 can reduce the magnetic near field radiation over a band of frequencies spanning from a third frequency ($f_3$) to a fourth frequency ($f_4$). Again, this band of frequencies can be chosen by selecting a corresponding resonant frequency ($f_r$) of the counterpoise 104. If future specifications are mandated which provide more stringent magnetic near field radiation limits, the RF circuit 100 may still meet such radiation limits, and thus eliminate the potential need for a redesign of the RF circuit 100, thereby saving providers of wireless communication devices' corresponding costs.

Figure 4:
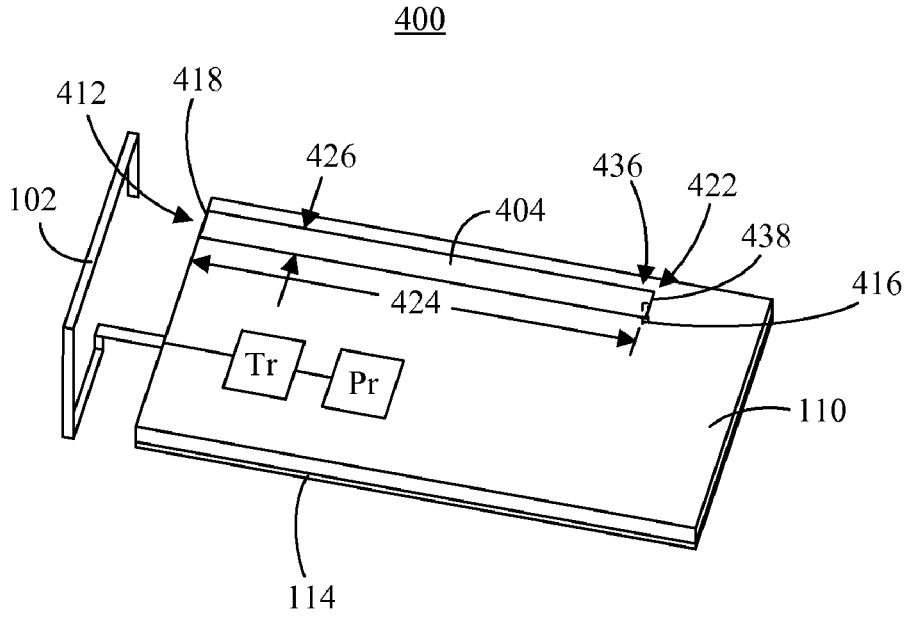
FIG. 4 depicts another RF circuit of a wireless communication device that is useful for understanding the present invention.

FIG. 4 depicts another RF circuit 400 of a wireless communication device which includes a counterpoise 404. The counterpoise 404 also may be used as a resonant structure that is electromagnetically coupled to the antenna 102, and may be configured to resonate at or near the operating frequency ($f_0$) of the antenna 102. Again, the counterpoise 404 can be configured to have a structure that is straight, curved, or comprise any of a myriad of different structural geometries. For example, the counterpoise 404 can include portions which are straight, portions which are curved, portions which include angles, and so on.

In this arrangement, rather than being electrically coupled to a ground potential (e.g. the ground plane 114) at or near an end 418 that is nearest to the antenna 102, the counterpoise 404 can be electrically coupled to a ground potential at a portion 436 of the counterpoise 404 that is distal from the antenna 102. In particular, the counterpoise 404 can be connected to the ground plane 114 at or near an end 438 of the counterpoise 404. In illustration, the counterpoise 404 can be electrically connected to the ground plane 114 with a via 416, a pin, or any other suitable conductor. In this arrangement, the counterpoise 404 can resemble a single port resonant line having an open first port 412 and a shorted load 420 at the portion 436 of the counterpoise 404.

Again, the length 424 of the counterpoise 404 can be selected to roughly correspond to a wavelength of the operating frequency of the antenna 102. For example, the length 424 can be equal to, or close to, a fraction of the wavelength (e.g. one-quarter of the wavelength), or any multiple of the fractional wavelength. In one arrangement, the length 424 of the counterpoise can be selected so that the input impedance ($Z_s$) of the counterpoise 404 appears low for near field radiation coupling from the antenna 102 to the counterpoise 404 at the first port 412 of the counterpoise 404. Accordingly, the counterpoise 404 can sink the portion of the near field electromagnetic signals generated by the antenna 102 that electromagnetically couple to the counterpoise 404. In addition, a width 426 of the counterpoise 404 can be selected to achieve a desired characteristic impedance ($Z_0$) for the counterpoise 404 based on the thickness of the printed circuit board 110 and the location of the ground plane 114.

The near field radiation generated by the RF circuit 400 can be measured in accordance with an applicable HAC specification, for example using an imaginary surface (not shown) as previously described.

Figure 5:
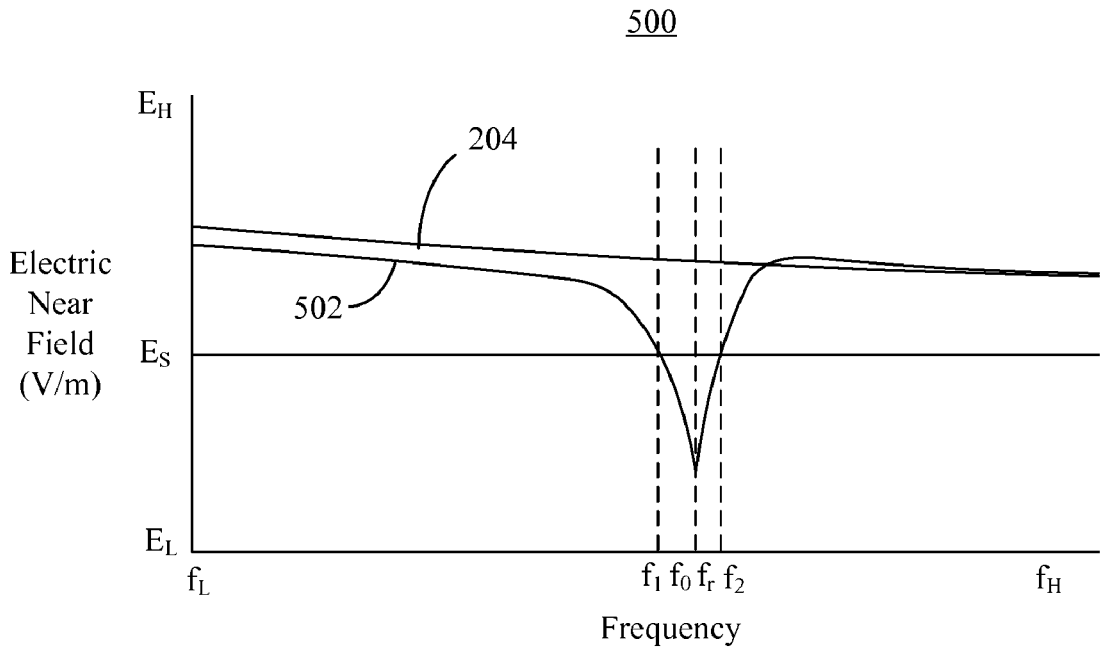
FIG. 5 depicts a chart presenting additional plots of an electric near field vs. frequency that is useful for understanding the present invention.

FIG. 5 depicts a chart 500 presenting a plot 502 of an electric near field generated by the antenna 102 vs. frequency when the counterpoise 404 is implemented in the RF circuit 400 of FIG. 4. The chart 500 also presents an electric near field limit ($E_s$) provided by an applicable HAC specification, as well as the plot 204 of the electric near field generated by the antenna 102 in an RF circuit which does not include the counterpoise 404.

Comparing the plot 502 to the plot 204, it can be seen that the antenna in an RF circuit that does not include a counterpoise exceeds the electric near field limit ($E_s$) when transmitting, and that the antenna 102 in the RF circuit 400, which includes the counterpoise 404, can transmit RF signals while complying with the electric near field limit ($E_s$). Again, the counterpoise 404 can reduce the electric near fields generated by the antenna 102 to be at or below the specified electric near field limit ($E_s$) at frequencies above a first frequency ($f_1$), and electric near fields generated by the antenna 102 can remain below the specified electric near field limit ($E_s$) over a band of frequencies spanning from the first frequency ($f_1$) to a second frequency ($f_2$).

The first frequency ($f_1$) and the second frequency ($f_2$) can be determined, at least in part, based on a resonant frequency ($f_r$) of the counterpoise 404, as well as the quality factor of the counterpoise 404. As noted, the resonant frequency ($f_r$) of the counterpoise 404 will correspond to its length 424, but other devices may be electrically coupled to the counterpoise 404 to change the resonant frequency ($f_r$), as will be discussed herein. Hence, the length 424 of the counterpoise 404 can be selected to choose the first frequency ($f_1$) and the second frequency ($f_2$) such that the operating frequency ($f_0$) of the antenna 102 falls within this frequency band.

Figure 6:
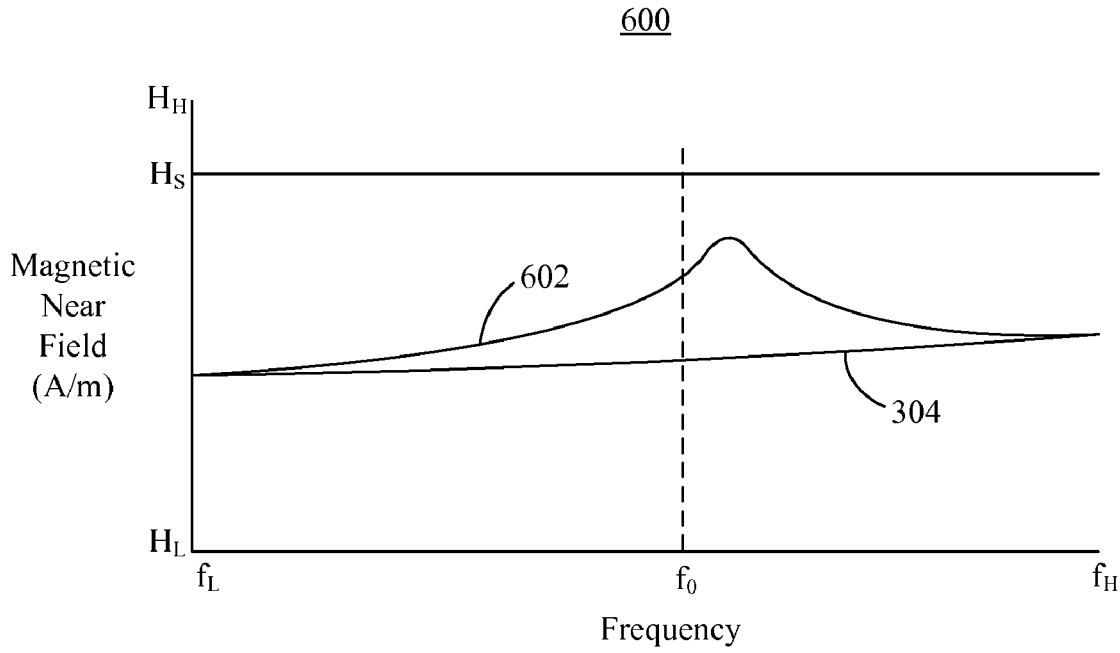
FIG. 6 depicts a chart presenting additional plots of a magnetic near field vs. frequency that is useful for understanding the present invention.

FIG. 6 depicts a chart 600 presenting a plot 602 of a magnetic near field generated by the antenna 102 vs. frequency when the counterpoise 404 is implemented in the RF circuit 400 of FIG. 4. The chart 600 also presents a magnetic near field limit ($H_s$) provided by an applicable HAC specification, as well as the plot 304 of the magnetic near field generated by the antenna 102 in an RF circuit which does not include the counterpoise 404.

In this arrangement, the level of the magnetic near field generated by the antenna 102 when the counterpoise 404 is implemented in the RF circuit 400 may actually exceed the level of the magnetic near field generated by the antenna 102 when the counterpoise 404 is not implemented. Nonetheless, the level of the magnetic near field generated by the antenna 102 in the RF circuit 400 still may be well below the specified magnetic near field limit ($H_s$), and thus is suitable for use in wireless communication devices that comply with the HAC specification.

Figure 7:
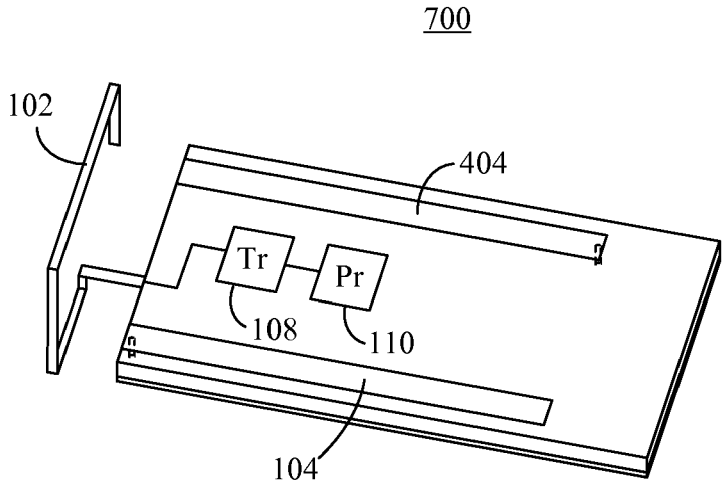
FIG. 7 depicts another RF circuit of a wireless communication device that is useful for understanding the present invention.

FIG. 7 depicts another RF circuit 700 of a wireless communication device that is useful for understanding the present invention. The RF circuit 700 can include both the counterpoise 104 described in FIG. 1 and the counterpoise 404 described in FIG. 4. Notably, the counterpoises 104, 404 can be tuned to different resonant frequencies ($f_{r1}$), ($f_{r2}$), Accordingly, the RF circuit 700 can be configured to comply with an applicable HAC specification over a fairly broad frequency range, as depicted in FIG. 8.

Figure 8:
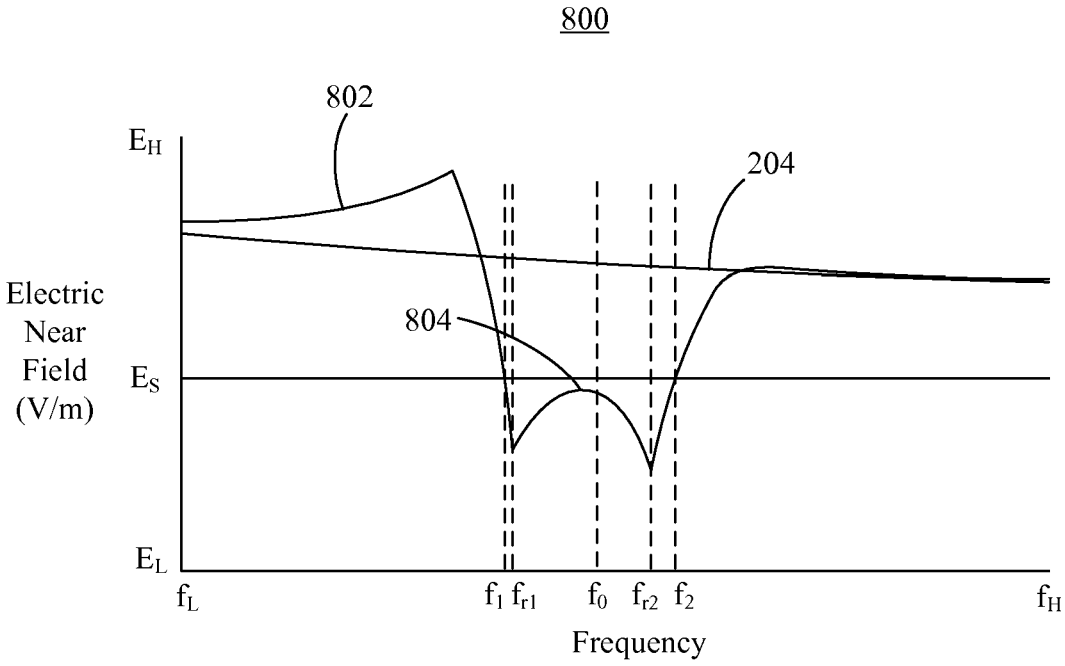
FIG. 8 depicts a chart presenting additional plots of an electric near field vs. frequency that is useful for understanding the present invention.

FIG. 8 depicts a chart 800 presenting a plot 802 of an electric near field generated by the antenna 102 vs. frequency when both the counterpoise 104 and the counterpoise 404 are implemented in the RF circuit 700 of FIG. 7. The chart 800 also presents an electric near field limit ($E_s$) provided by an applicable HAC specification, and the plot 204 of the electric near field generated by the antenna 102 in an RF circuit which does not include the counterpoises 104, 404.

The resonant frequency ($f_{r1}$) of the first counterpoise 104 and the resonant frequency of the second counterpoise 404 ($f_{r2}$) can be spaced apart in the frequency spectrum so as to broaden the frequency range ($f_1$) to ($f_1$) where the electric near fields generated by the antenna 102 remain below the electric near field limit ($E_s$). Thus, the RF circuit 700 can operate over a broader frequency band in comparison to the embodiments previously described. In the present example, the resonant frequency ($f_{r1}$) of the counterpoise 104 is lower than the resonant frequency ($f_{r2}$) of the counterpoise 404. Nonetheless, the invention is not limited in this regard. For instance, the counterpoise 104 can be tuned to resonate at the resonant frequency ($f_{r2}$) and the counterpoise 404 can be tuned to resonate at the resonant frequency ($f_{r1}$).

Between the frequencies ($f_1$) and ($f_1$) the electric near fields generated by the antenna 102 may reach a peak 804. In general, the peak 804 may increase as the frequency span between the frequencies ($f_1$) and ($f_1$) increases, and the peak 804 may decrease as the frequency span between the frequencies ($f_1$) and ($f_1$) decreases. In this regard, the frequencies ($f_1$) and ($f_1$) can be selected to provide a suitable margin between the peak 804 and the applicable electric near field limit ($E_s$).

Figure 9:
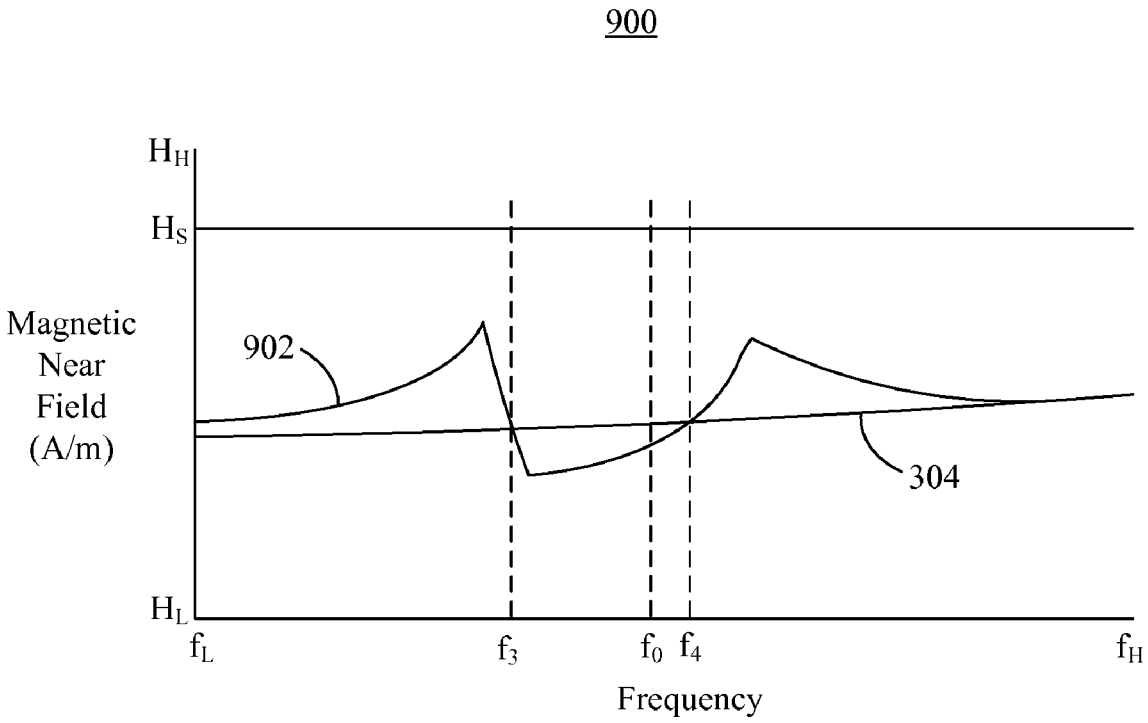
FIG. 9 depicts a chart presenting additional plots of a magnetic near field vs. frequency that is useful for understanding the present invention.

FIG. 9 depicts a chart 900 presenting a plot 902 of a magnetic near field generated by the antenna 102 vs. frequency when the counterpoise 104 of FIG. 1 and the counterpoise 404 of FIG. 4 are implemented in the RF circuit 700 of FIG. 7. The chart 900 also presents a magnetic near field limit ($H_s$) provided by an applicable HAC specification, and the plot 304 of the magnetic near field generated by the antenna 102 in an RF circuit which does not include the counterpoises 104, 404. By comparing the plot 902 to the plot 304, it can be seen that use of the counterpoise 104 within the RF circuit 100 can reduce the magnetic near field radiation over a band of frequencies spanning from a third frequency ($f_3$) to a fourth frequency ($f_4$). Again, this band of frequencies can be chosen by selecting corresponding resonant frequencies ($f_{r1}$) and ($f_{r2}$) of the counterpoises 104, 404.

Figure 10:
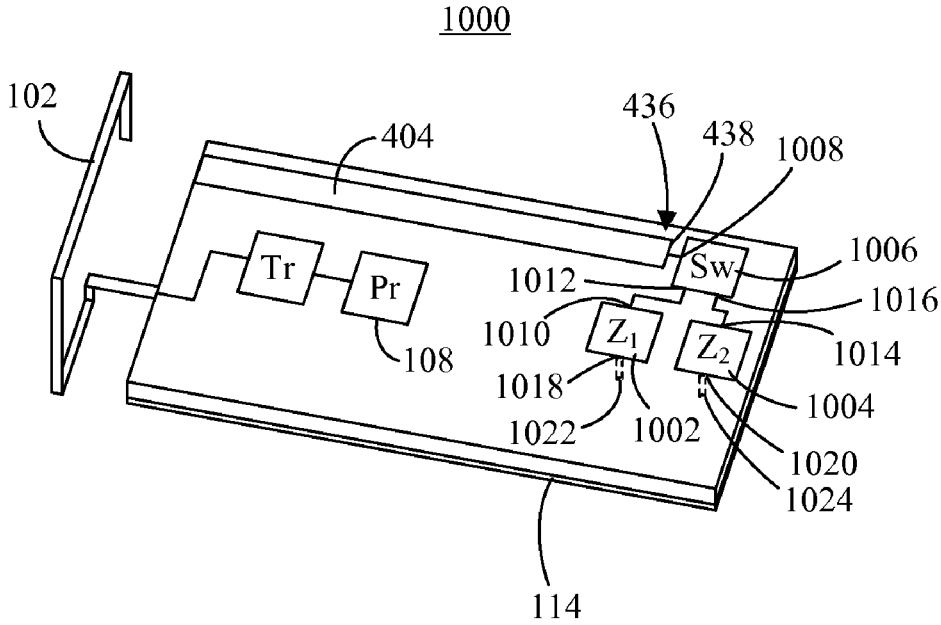
FIG. 10 depicts another RF circuit of a wireless communication device that is useful for understanding the present invention.

FIG. 10 depicts another RF circuit 1000 of a wireless communication device that is useful for understanding the present invention. In this arrangement, the RF circuit 1000 can include the counterpoise 404 described in FIG. 4, which as noted may be electromagnetically coupled to the antenna 102. In lieu of grounding the portion 436 of the counterpoise 404 that is distal from the antenna 102, however, the portion of 436 can be electrically coupled to ground via one or more passive devices 1002, 1004 having associated impedances.

The passive devices 1002, 1004 can present various load impedances to the counterpoise 404. In conjunction with the first passive device 1002, the counterpoise 404 can resonate at a first resonant frequency ($f_{r1}$). In conjunction with the second passive device 1004, the counterpoise 404 can resonate at a second resonant frequency ($f_{r2}$). Other passive devices (not shown) also can be provided to resonate at other frequencies. Accordingly, use of the passive devices 1002, 1004 as load impedances electrically coupled to the counterpoise 404 can enable the resonant frequency ($f_r$) of the counterpoise 404 to be selectively adjusted to any of a variety of frequencies.

In illustration, the end 438 of the counterpoise 404 can be electrically coupled to a first port 1008 of a switch 1006. The switch may be an electronic or a mechanical device that makes or breaks the contact between two or more terminal ports. In one arrangement, the switch 1006 can be a single pole-double throw switch. A first port 1010 of a first passive device 1002 can be electrically coupled to a second port 1012 of the switch 1006, and a first port 1014 of a second passive device 1004 can be electrically coupled to a third port 1016 of the switch 1006. Other passive devices also can be electrically coupled to additional ports of the switch. For example, the switch 1006 can be a single pole-four throw switch, and four passive devices can be provided. Notwithstanding, any number of passive devices can be provided, and one or more switches 1006 can be used to selectively activate these passive devices. It will be understood by the skilled artisan that the switch 1006 (or switches) can be an electronic device, a mechanical device, an electromechanical device, or any other suitable type of switch that makes or breaks electrical coupling between two or more ports.

A second port 1018 of the first passive device 1002 and a second port 1020 of the second passive device 1004 can be electrically coupled to a ground potential. For example, the ports 1016, 1018 can be connected to the ground plane 114 with respective vias 1022, 1024, pins, or any other suitable conductors. Any additional passive devices also may have ports that are connected to a ground potential in a similar manner.

Each of the passive devices 1002, 1004 can comprise, for instance, one or more capacitors, inductors and/or resistors. As such, each of the passive devices 1002, 1004 can be configured to provide a particular load impedance to the counterpoise 404, and thus to achieve a particular resonant frequency with the counterpoise 404. In operation, the switch 1006 can be operated to connect the first port 1008 of the switch 1006 to the second port 1012, the third port 1016, or any other ports, thus selectively coupling the counterpoise 404 to ground potential using either of the passive devices 1002, 1004. Operation of the switch 1006 can be controlled by a suitable processor, for example the processor 108.

Figure 11:
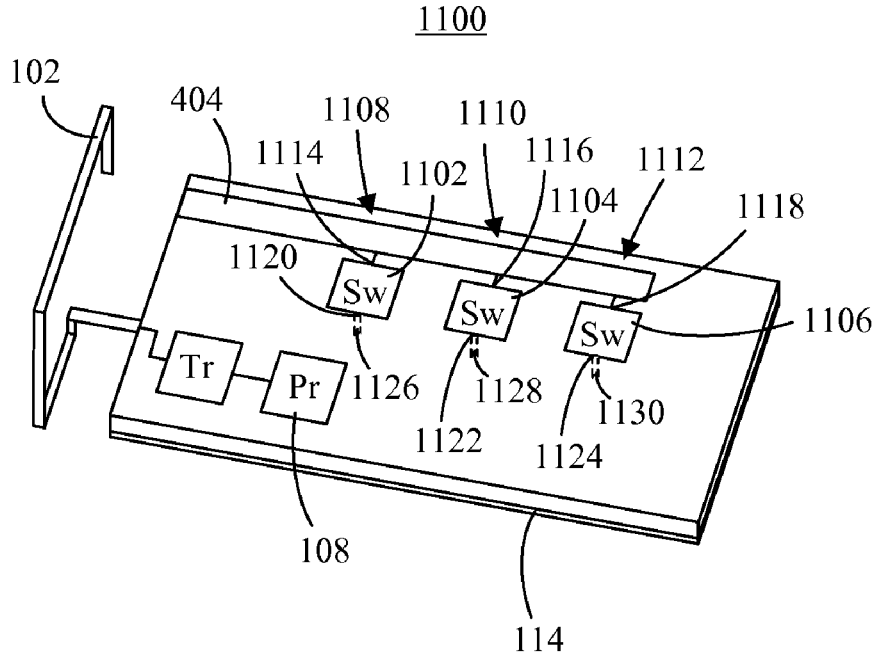
FIG. 11 depicts another RF circuit of a wireless communication device that is useful for understanding the present invention.

FIG. 11 depicts another RF circuit 1100 of a wireless communication device that is useful for understanding the present invention. Again, in this arrangement the RF circuit 1100 can include the counterpoise 404 described in FIG. 4 that is electromagnetically coupled to the antenna 102. In this arrangement, a plurality of switches 1102, 1104, 1106 can be provided. Each of the switches 1102, 1104, 1106 can comprise a respective first port 1114, 1116, 1118 and a respective second port 1120, 1122, 1124. Further, the second port 1120, 1122, 1124 can be electrically coupled to the ground plane 114 with respective vias 1126, 1128, 1130, pins, or any other suitable conductors.

In operation, the switches can be selectively closed to choose which portion 1108, 1110, 1112 of the counterpoise 404 is electrically coupled to ground and any given time, thereby providing another manner in which the resonant frequency of the counterpoise 404 can be selectively adjusted. For example, the switch 1102 can be closed to electrically couple the portion 1108 of the counterpoise 404 to ground potential to achieve a first resonant frequency. Similarly, the switch 1104 can be closed to electrically couple the portion 1110 of the counterpoise 404 to ground potential to achieve a second resonant frequency that is lower than the first resonant frequency, and the switch 1106 can be closed to electrically couple the portion 1112 of the counterpoise 404 to ground potential to achieve a third resonant frequency that is lower than the second resonant frequency. Again, operation of the switches 1102, 1104, 1106 can be controlled by a suitable processor, such as the processor 108.

Figure 12:
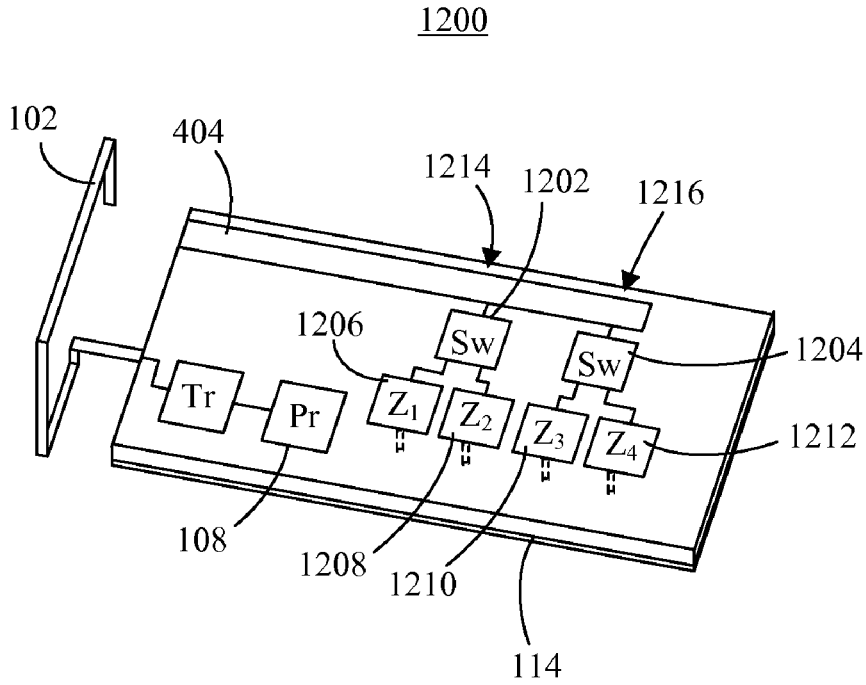
FIG. 12 depicts another RF circuit of a wireless communication device that is useful for understanding the present invention.

FIG. 12 depicts another RF circuit 1200 of a wireless communication device that is useful for understanding the present invention. In this arrangement the RF circuit 1200 can include the counterpoise 404 described in FIG. 4 that is electromagnetically coupled to the antenna 102. Moreover, the RF circuit 1200 can operate similarly to the operation described for the RF circuits 1000, 1100 of FIG. 10 and FIG. 11, respectively. Specifically, the RF circuit 1200 can include a plurality of switches 1202, 1204, and each of the switches 1202, 1204 can be electrically coupled to the first port of one or more passive devices 1206, 1208, 1210, 1212, each of which may have a second port electrically coupled to the ground plane 114.

The switches 1202, 1204 can be selectively operated to electrically couple the counterpoise 404 to one or more of the passive devices 1206-1212, thereby providing another manner in which the resonant frequency ($f_r$) of the counterpoise 404 can be selectively adjusted. As noted, a suitable processor, such as the processor 108, can be used to selectively control operation of the switches 1202, 1204.

In one arrangement, the switches 1202, 1204 can be electrically coupled to different portions 1214, 1216 of the counterpoise 404. In another arrangement, the switches 1202, 1204 can be electrically coupled to the same portion of the counterpoise 404, for example to the portion 1216. The switches 1202, 1204 can be selectively operated to electrically couple the counterpoise 404 to one or more of the passive devices 1206-1212 to choose a desired resonant frequency ($f_r$) of the counterpoise 404. In this regard, the switch 1202 can remain open while the switch 1204 electrically couples the counterpoise 404 to one, or both, of the passive devices 1210, 1212. Similarly, the switch 1204 can remain open while the switch 1202 electrically couples the counterpoise 404 to one, or both, of the passive devices 1206, 1210. In another arrangement, the switch 1202 can electrically couple the counterpoise 404 to one or more of the passive devices 1206, 1208, and simultaneously the switch 1204 can electrically couple the counterpoise 404 to one or more of the passive device 1210, 1212.

Selective operation of the switches 1202, 1204 in this manner can allow for the selection of any of a variety of desired resonant frequencies ($f_r$) for the counterpoise 404, and the number of available resonant frequencies ($f_r$) need not be limited to the number of passive devices 1206-1212. For example, the passive device 1206 may be electrically coupled between the counterpoise 404 and the ground plane 114 to provide a first resonant frequency ($f_{r1}$), and another resonant frequency ($f_{r2}$) can be selected by coupling both the passive devices 1206, 1210 between the counterpoise 404 and the ground plane 114, thus presenting an impedance load equal to the parallel combination of $Z_1$ and $Z_3$. Yet another resonant frequency ($f_r$) may be selected by coupling the passive devices 1208, 1212 between the counterpoise 404 and the ground plane 114, thereby presenting an impedance load equal to the parallel combination of $Z_2$ and $Z_4$. Of course, different parallel combinations can be implemented to achieve a number of resonant frequencies.

In one combination of one or more passive devices, the effective parallel impedance may be a high impedance, thereby electrically uncoupling the counterpoise 404 from the ground plane 114, which can be advantageous when the antenna 102 is operating in the receive band. In an alternative arrangement, each of the switches 1202, 1204 may be controlled to remain open simultaneously, thereby leaving the passive devices 1206-1212 electrically uncoupled from the counterpoise 404, in which case the resonant frequency ($f_r$) of the counterpoise 404 can be independent of the passive devices 1206-1212. Further, different combinations of the passive devices may be selected to achieve different operating characteristics. For instance, a particular combination of passive devices 1206-1212 may be coupled to the counterpoise 404 while the RF communication device is operating in transmit mode, and another combination of passive devices 1206-1212 may be coupled to the counterpoise 404 while the RF communication device is operating in receive mode.

Figure 13:
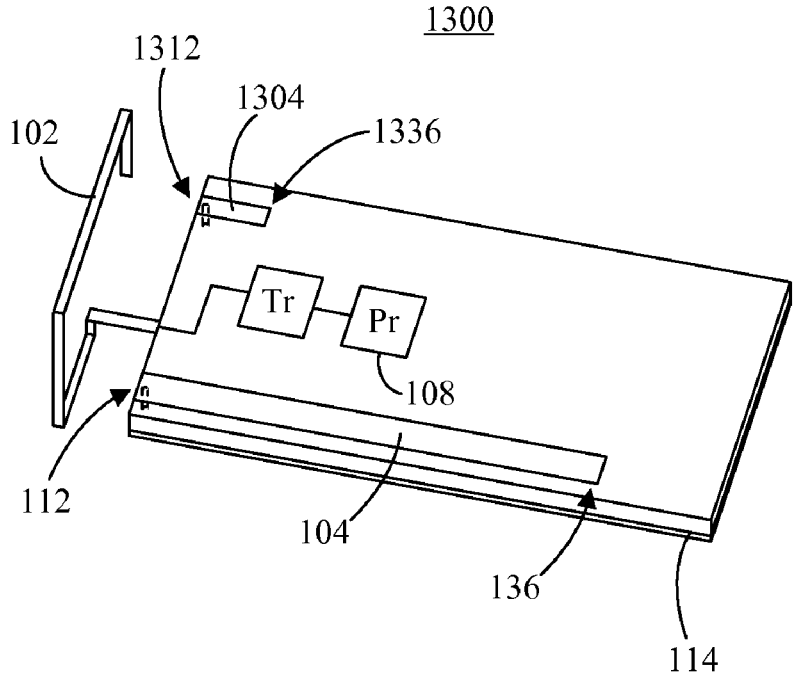
FIG. 13 depicts another RF circuit of a wireless communication device that is useful for understanding the present invention.

FIG. 13 depicts yet another RF circuit 1300 of a wireless communication device that is useful for understanding the present invention. Again, in this arrangement the RF circuit 1300 can include the counterpoise 104 described in FIG. 1 that is electromagnetically coupled to the antenna 102 and the ground plane 114. In this arrangement, one or more other counterpoises 1304 can be provided which are configured to resonate at a different frequency (e.g. at a higher frequency) than the counterpoise 104. Accordingly, a wireless communication device incorporating the RF circuit 1300 can operate at a plurality of frequencies while complying with applicable HAC specifications at each of the operating frequencies. The counterpoise 1304 also can be configured to have a structure that is straight, curved, or comprise any of a myriad of different structural geometries.

The counterpoises 104, 1304 can be electrically coupled to a ground potential at respective ports 112, 1312, at portions 136, 1336, or at any other desired portions of the respective counterpoises 104, 1304. For example, the counterpoise 104 can be electrically coupled to a ground potential at the port 112 and the counterpoise 104 can be electrically coupled to a ground potential at the port 1312. In other arrangements, the counterpoise 104 can be electrically coupled to a ground potential at the port 112 and the counterpoise 1304 can be electrically coupled to a ground potential at the portion 1336, the counterpoise 104 can be electrically coupled to a ground potential at the portion 136 and the counterpoise 1304 can be electrically coupled to a ground potential at the port 1312, or the counterpoises 104, 1304 can be electrically coupled to a ground potential at the respective portions 136, 1336. Moreover, switches and/or a combination of switches and passive devices, such as those previously described, can be used to select desired resonant frequencies ($f_r$), of the respective counterpoises 104, 1304, for instance under control of the processor 108.

Figure 14:
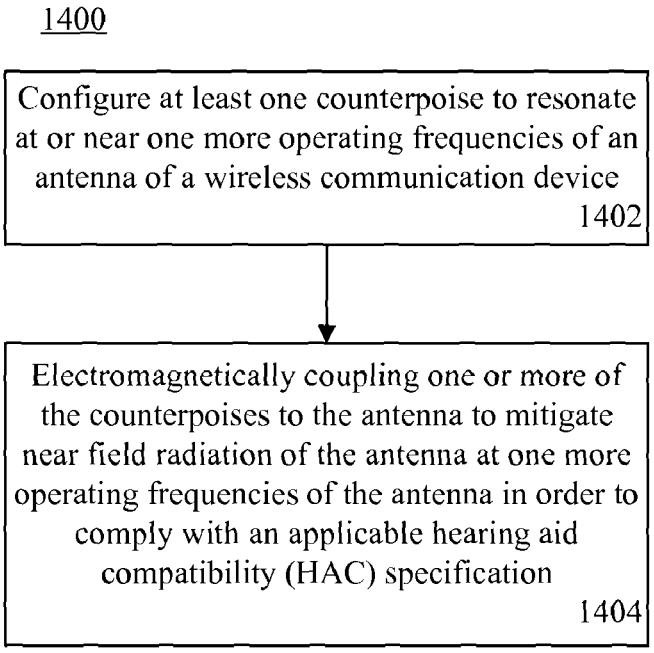
FIG. 14 is a flowchart presenting a method of mitigating near field radiation generated by a wireless communication device, which is useful for understanding the present invention.

FIG. 14 is a flowchart presenting a method 1400 of mitigating near field radiation generated by a wireless communication device, which is useful for understanding the present invention. At step 1402, one or more counterpoises can be configured to resonate at or near at least one operating frequency of an antenna of the wireless communication device. For example, in one arrangement, a first counterpoise can be configured to resonate at or near a first operating frequency of the antenna. In another arrangement, the first counterpoise and a second counterpoise both can be configured to resonate at or near the operating frequency of the antenna. In yet another arrangement, a first counterpoise can be configured to resonate at or near a first operating frequency of the antenna, and a second counterpoise can be configured to resonate at or near a second operating frequency of the antenna. Still, other counterpoises can be provided to resonate at or near other operating frequencies of the antenna, and the invention is not limited in this regard.

At step 1404, the counterpoise(s) can be electromagnetically coupled to the antenna to mitigate near field radiation of the antenna at one or more operating frequencies of the antenna in order to comply with an applicable HAC specification.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The term "electrically coupled," as used herein, is defined as connected, although not necessarily directly, and not necessarily mechanically, e.g., communicatively linked through a communication channel or pathway or another component or system. The term "electromagnetically coupled," as used herein, is defined as being coupled via one or more electric and/or magnetic fields via a medium that is generally not considered to be a conductor, for example a dielectric medium.

Moreover, as used herein, ordinal terms (e.g. first, second, third, fourth, fifth, sixth, seventh, eighth, ninth, tenth, and so on) distinguish one message, signal, item, object, device, system, apparatus, step, process, or the like from another message, signal, item, object, device, system, apparatus, step, process, or the like. Thus, an ordinal term used herein need not indicate a specific position in an ordinal series. For example, a process identified as a "second process" may occur before a process identified as a "first process." Further, one or more processes may occur between a first process and a second process.

This invention can be embodied in other forms without departing from the spirit or essential attributes thereof. Accordingly, reference should be made to the following claims, rather than to the foregoing specification, as indicating the scope of the invention.

What is claimed is:

1. A method of mitigating near field radiation generated by a wireless communication device, comprising:

configuring at least a first counterpoise to resonate at or near at least one operating frequency of an antenna of the wireless communication device, said configuring the first counterpoise comprising electrically coupling a port of the first counterpoise to a ground potential, the port being proximate to the antenna; and electromagnetically coupling the first counterpoise to the antenna to mitigate near field radiation of the antenna at the at least one operating frequency of the antenna.

2. A method of mitigating near field radiation generated by a wireless communication device, comprising:

configuring at least a first counterpoise to resonate at or near at least one operating frequency of an antenna of the wireless communication device, said configuring the first counterpoise comprising:

positioning a port of the first counterpoise proximate to the antenna;

positioning a port of a second counterpoise proximate to the antenna; and electrically coupling the port of the first counterpoise to a ground potential, the port being proximate to the antenna; and electromagnetically coupling the first counterpoise to the antenna to mitigate near field radiation of the antenna at the at least one operating frequency of the antenna.

3. The method of claim 2, wherein configuring at least the first counterpoise to resonate at or near the at least one operating frequency of the antenna of the wireless communication device further comprises:

electrically coupling a portion of the second counterpoise to the ground potential, the portion of the second counterpoise being distal from the antenna.

4. A method of mitigating near field radiation generated by a wireless communication device, comprising:

configuring at least a first counterpoise to resonate at or near at least one operating frequency of an antenna of the wireless communication device, said configuring the first counterpoise comprising:

electrically coupling a portion of the first counterpoise to a first port of a switch, the portion of the first counterpoise being distal from the antenna;

electrically coupling a second port of the switch to a ground potential via a first passive device having a first impedance selected to achieve a first resonant frequency of the first counterpoise;

electrically coupling a third port of the switch to the ground potential via a second passive device having a second impedance selected to achieve a second resonant frequency of the first counterpoise; and selectively connecting the first port of the switch to the second port of the switch or the third port of the switch; and electromagnetically coupling the first counterpoise to the antenna to mitigate near field radiation of the antenna at the at least one operating frequency of the antenna.

5. A method of mitigating near field radiation generated by a wireless communication device, comprising:

configuring at least a first counterpoise to resonate at or near at least one operating frequency of an antenna of the wireless communication device, said configuring the first counterpoise comprising:

electrically coupling a first portion of the first counterpoise to a first port of a first switch, the first switch having a second port electrically coupled to a ground potential;

electrically coupling at least a second portion of the first counterpoise to a first port of at least a second switch, the second switch having a second port electrically coupled to the ground potential; and selectively closing the first switch or the second switch to change a resonant frequency of the first counterpoise; and electromagnetically coupling the first counterpoise to the antenna to mitigate near field radiation of the antenna at the at least one operating frequency of the antenna.

6. An RF circuit for a wireless communication device, comprising:

an antenna; and at least a first counterpoise configured to resonate at or near at least one operating frequency of the antenna;

wherein the first counterpoise is electromagnetically coupled to the antenna to mitigate near field radiation of the antenna at the at least one operating frequency of the antenna, and a port of the first counterpoise is electrically coupled to a ground potential, the port being proximate to the antenna.

7. An RF circuit for a wireless communication device comprising:

an antenna;

at least a first counterpoise configured to resonate at or near at least one operating frequency of the antenna; and a second counterpoise comprising a port that is positioned proximate to the antenna;

wherein the first counterpoise is electromagnetically coupled to the antenna to mitigate near field radiation of the antenna at the at least one operating frequency of the antenna, a port of the first counterpoise is positioned proximate to the antenna, and the port of the first counterpoise is electrically coupled to a ground potential, the port being proximate to the antenna.

8. The RF circuit of claim 7, wherein:

a portion of the second counterpoise is electrically coupled to a ground potential, the portion of the second counterpoise being distal from the antenna.

9. An RF circuit for a wireless communication device, comprising:

an antenna; and at least a first counterpoise configured to resonate at or near at least one operating frequency of the antenna;

wherein:

the first counterpoise is electromagnetically coupled to the antenna to mitigate near field radiation of the antenna at the at least one operating frequency of the antenna;

a portion of the first counterpoise is electrically coupled to a first port of a switch, the portion of the first counterpoise being distal from the antenna;

a second port of the switch is electrically coupled to a ground potential via a first passive device having a first impedance selected to achieve a first resonant frequency of the first counterpoise;

a third port of the switch is electrically coupled to the ground potential via a second passive device having a second impedance selected to achieve a second resonant frequency of the first counterpoise; and the first port of the switch is selectively connected to the second port of the switch or the third port of the switch.

10. An RF circuit for a wireless communication device, comprising:

an antenna; and at least a first counterpoise configured to resonate at or near at least one operating frequency of the antenna;

wherein:

the first counterpoise is electromagnetically coupled to the antenna to mitigate near field radiation of the antenna at the at least one operating frequency of the antenna;

a first portion of the first counterpoise is electrically coupled to a first port of a first switch, the first switch having a second port electrically coupled to a ground potential;

at least a second portion of the first counterpoise is electrically coupled to a first port of at least a second switch, the second switch having a second port electrically coupled to a ground potential; and the first switch or the second switch is selectively closed to change a resonant frequency of the first counterpoise.

* * * * *